US006282778B1

(12) United States Patent
Fox et al.

(10) Patent No.: US 6,282,778 B1
(45) **Date of Patent: *Sep. 4, 2001**

(54) COAXIAL CABLE

(75) Inventors: Steve Allen Fox, Hickory, NC (US); Michael Ahern, deceased, late of Keyser, WV (US), by William L. Ahern, legal representative

(73) Assignee: CommScope Properties, LLC, Sparks, NV (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/415,871

(22) Filed: Oct. 8, 1999

Related U.S. Application Data

(62) Division of application No. 08/935,381, filed on Sep. 23, 1997, now Pat. No. 6,037,545
(60) Provisional application No. 60/026,700, filed on Sep. 25, 1996.

(51) Int. Cl.[7] ..... H01B 13/20
(52) U.S. Cl. ..... 29/828; 29/825; 174/110 F; 174/110 R
(58) Field of Search ..... 29/825, 828; 174/28, 174/102 R, 110 F, 110 PM

(56) References Cited

U.S. PATENT DOCUMENTS

| | | | | |
|---|---|---|---|---|
| 3,193,712 | | 7/1965 | Harris . | |
| 3,309,455 | | 3/1967 | Mildner . | |
| 4,104,481 | * | 8/1978 | Wilkenloh et al. | 174/28 |
| 4,107,354 | | 8/1978 | Wilkenloh et al. . | |
| 4,220,807 | | 9/1980 | Anastasi et al. . | |
| 4,472,595 | | 9/1984 | Fox et al. . | |
| 5,110,998 | | 5/1992 | Muschiatti . | |
| 5,210,377 | | 5/1993 | Kennedy et al. . | |
| 5,234,963 | | 8/1993 | Garcia et al. . | |
| 5,235,299 | | 8/1993 | Vaille et al. . | |
| 5,239,134 | | 8/1993 | Pote et al. . | |
| 5,274,712 | | 12/1993 | Lindsey et al. . | |
| 5,286,924 | | 2/1994 | Loder et al. . | |
| 5,393,929 | | 2/1995 | Yagihashi . | |
| 5,521,331 | | 5/1996 | Hillburn . | |
| 5,527,573 | | 6/1996 | Park et al. . | |
| 5,707,571 | * | 1/1998 | Reedy | 264/45.3 |
| 5,926,949 | * | 7/1999 | Moe et al. | 29/828 |

FOREIGN PATENT DOCUMENTS

| | | |
|---|---|---|
| 0099723 | 2/1984 | (EP) . |
| 2152396 | 4/1973 | (FR) . |

OTHER PUBLICATIONS

"Blowing Agents for Thermoplastics Endothermics on the Rise", *Plastics Technology*, Mar. 1996, pp. 42–45.

Technology NewsFocus, *Plastics Technology*, Mar. 1996, p. 11.

International Search Report for PCT/US97/16810 by J. Demolder, completed Jan. 19, 1998.

* cited by examiner

*Primary Examiner*—Lee Young
*Assistant Examiner*—Rick Kiltae Chang
(74) *Attorney, Agent, or Firm*—Alston & Bird LLP

(57) ABSTRACT

A flexible coaxial cable comprises a core including at least one inner conductor and a closed cell foam dielectric surrounding the inner conductor. The flexible coaxial cable also includes a tubular metallic sheath closely surrounding and preferably bonded to the core. The closed cell foam dielectric is a low density polyolefin foam and possesses improved electrical properties over conventional foam dielectrics. The coaxial cable has a velocity of propagation of greater than 90 percent of the speed of light but still maintains high flexibility and bending characteristics.

6 Claims, 2 Drawing Sheets

COAXIAL CABLE

CROSS-REFERENCE TO RELATED APPLICATIONS

This application is a division of U.S. patent application Ser. No. 08/935,381, filed Sep. 23, 1997, now U.S. Pat. No. 6,037,545, which claims the benefit of U.S. Provisional Application Ser. No. 60/026,700, filed Sep. 25, 1996, under 35 U.S.C. § 119(e).

FIELD OF THE INVENTION

The present invention relates to a coaxial able, and more particularly to an improved low-loss coaxial cable having enhanced bending and handling characteristics and improved attenuation properties for a given nominal size.

BACHGROUND OF THE INVENTION

The coaxial cables commonly used today for transmission of RF signals, such as television signals, for example, include a core containing an inner conductor and a metallic sheath surrounding the core and serving as an outer conductor. A dielectric surrounds the inner conductor and electrically insulates it from the surrounding metallic sheath. In some types of coaxial cables, air is used as the dielectric material, and electrically insulating spacers are provided at spaced locations throughout the length of the cable for holding the inner conductor coaxially within the surrounding sheath. In other known coaxial cable constructions, an expanded foam dielectric surrounds the inner conductor and fills the spaces between the inner conductor and the surrounding metallic sheath.

One important attribute of coaxial cable is its ability to propagate a signal with as little attenuation as possible. One method of measuring signal propagation is expressed as a percentage of the speed of light, commonly known as velocity of propagation ($V_p$) . Coaxial cables of the "air dielectric" type of construction have very good signal propagation characteristics, with $V_p$values typically 90% or higher. However, these coaxial cables unfortunately have relatively limited bending characteristics and are susceptible to buckling, flattening or collapsing of the outer sheath, which adversely affect the electrical properties of the cable and render it unusable. Consequently, air dielectric type coaxial cables require very careful handling during installation to avoid such damage. Additionally, they are not recommended for use in installations requiring small radius bends or frequent reverse bends.

Coaxial cables of the "foam dielectric" type of construction, on the other hand, possess significantly better bending properties than air dielectric cables. They can be more easily installed without undue concern over buckling, flattening or collapsing of the outer sheath and they can be used in environments where air dielectric type cables are unsuitable. However, they are hampered by a somewhat lower velocity of propagation than air dielectric type cables. This reduction in $V_p$ and increase in attenuation loss is attributable to the foam dielectric.

An early foam dielectric coaxial cable used a polystyrene foam produced with a pentane blowing agent, as mentioned in U.S. Pat. No. 4,104,481 to Wilkenloh et al. While the foam dielectric provided excellent signal propagation, with velocity of propagation ($V_p$) values of 90% and higher, the use of pentane as a blowing agent and the open cell nature of the resulting polystyrene foam were drawbacks which limited the widespread commercial use of this cable construction.

An alternative to the open cell polystyrene foam dielectrics has been to use a closed cell expanded polyolefin foam dielectric. U.S. Pat. No. 4,104,481 describes a coaxial cable with a polyolefin foam dielectric comprising polyethylene or polypropylene which is foamed using a chlorofluorocarbon blowing agent and a nucleating agent. The resulting foam dielectric possesses increased bending properties without the negative affects associated with the polystyrene/pentane systems. U.S. Pat. No. 4,472,595 to Fox et al. discloses a foam dielectric coaxial cable having enhanced handling and bending characteristics.

More recently, due to environmental concerns and governmental regulations, manufacturers of foams have discontinued the use of most chlorofluorocarbons and have turned to alternative blowing agents such as nitrogen, sulfur hexafluoride and carbon dioxide. However, the need exists to improve the signal propagation properties of foam dielectrics produced with these alternative blowing agents.

SUMMARY OF THE INVENTION

In accordance with the present invention, a foam dielectric coaxial cable is provided which has a velocity of propagation ($V_p$) of greater than about 90% the speed of light- This high propagation value is a very significant improvement over the propagation values of the presently available foam dielectric coaxial cables and is comparable to the signal propagation properties of air dielectric type coaxial cables. However, the foam dielectric coaxial cable of the invention has flexibility and bending characteristics which are vastly superior to air dielectric type coaxial cables. Thus, the coaxial cable of the present invention provides excellent signal propagation properties in combination with excellent flexibility and bending characteristics.

The coaxial cable of the present invention comprises a core including at least one inner conductor and a closed cell foam dielectric surrounding the inner conductor. A tubular metallic sheath closely surrounds and is preferably bonded to the core. The flexible coaxial cable also may include a protective jacket closely surrounding the tubular metallic sheath. The coaxial cable has a velocity of propagation ($V_p$) of 90 percent or greater.

The foam dielectric of the coaxial cable of the present invention has a low density, preferably no more than about 0.22 g/cc. The foam has a fine, uniform closed cell structure, preferably with a maximum cell diameter of 170 microns. The foam dielectric is preferably formed from a polyolefin, and most desirably from a blend of low density polyethylene and high density polyethylene. These characteristics provide a high core stiffness, which gives excellent flexibility and bending characteristics and also contributes to the excellent velocity of propagation of the coaxial cable.

These and other features and advantages of the present invention will become more readily apparent to those skilled in the art upon consideration of the following detailed description which describes both the preferred and alternative embodiments of the invention.

DETAILED DESCRIPTION OF THE INVENTION

Figure 1:
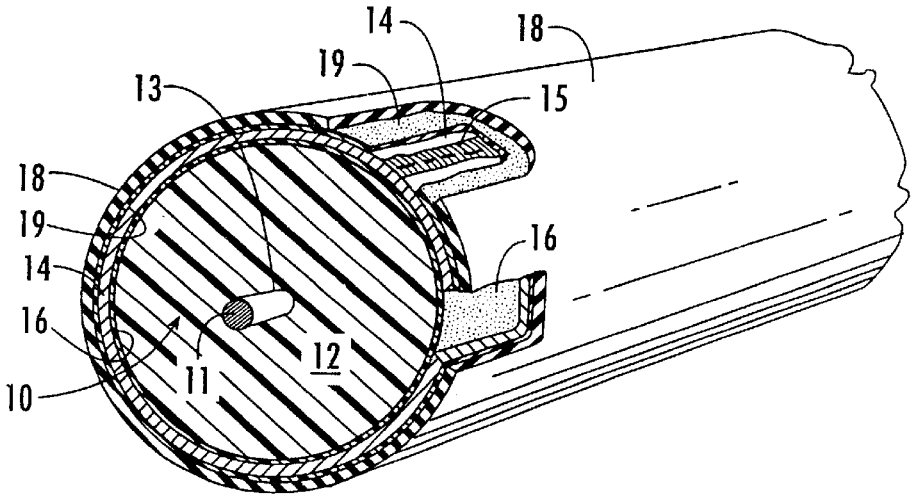
FIG. 1 is a perspective view showing a coaxial cable in accordance with the present invention in cross-section and with portions of the cable broken away for purposes of clarity of illustration.

FIG. 1 illustrates a coaxial cable produced in accordance with the present invention. The coaxial cable comprises a core 10 which includes an inner conductor 11 of a suitable electrically conductive material such as copper, aluminum or copper-clad aluminum, and a surrounding continuous cylindrical expanded foam plastic dielectric material 12. In the embodiment illustrated, only a single inner conductor 11 is shown, as this is the most common arrangement for coaxial cables of the type used for transmitting RF signals, such as television signals. However, it would be understood that the present invention is applicable also to cables having more than one inner conductor insulated from one another and forming a part of the core.

Preferably, the inner conductor 11 is bonded to the expanded foam plastic dielectric material 12 by a thin layer of adhesive 13 to form the core 10. Suitable adhesives for this purpose include ethylene acrylic acid (EAA) and ethylene methylacrylate (EMA) copolymers. Such adhesives are described in, for example, U.S. Pat. Nos. 2,970,129; 3,520,861; 3,681,515; and 3,795,540.

The dielectric 12 is a low loss dielectric formed of a suitable plastic such as a polyolefin. In order to reduce the mass of the dielectric per unit length and hence reduce the dielectric constant, the dielectric material should be of an expanded cellular foam composition. Furthermore, the foam should be of a closed cell construction to provide the desired high core stiffness and to prevent transmission of moisture along the cable. Preferably, the closed cell foam dielectric of the invention is an expanded polyolefin and a particularly preferred foam dielectric is an expanded blend of low density polyethylene and high density polyethylene. The preferred foam dielectric compositions of the invention are described in more detail below.

Closely surrounding the core is a continuous tubular metallic sheath 14. The sheath 14 is characterized by being both mechanically and electrically continuous. This allows the sheath 14 to effectively serve to mechanically and electrically seal the cable against outside influences as well as to seal the cable against leakage of RF radiation. The tubular metallic sheath 14 may be formed of various electrically conductive metals such as copper or aluminum. The tubular metallic sheath 14 has a wall thickness selected so as to maintain a T/D ratio (ratio of wall thickness to outer diameter) of less than 2.5 percent. For the cable illustrated, the wall thickness is less than 0.030 inch.

In the preferred embodiment illustrated, the continuous sheath 14 is formed from a flat metal strip which is formed into a tubular configuration with the opposing side edges of the strip butted together, and with the butted edges continuously joined by a continuous longitudinal weld, indicated at 15. While production of the sheath 14 by longitudinal welding has been illustrated as preferred, persons skilled in the art will recognize that other methods for producing a mechanically and electrically continuous thin walled tubular metallic sheath could also be employed. For example, as is understood by those skilled in the art, methods which provide for a "seamless" longitudinal sheath may also be employed.

The inner surface of the tubular sheath 14 is continuously bonded throughout its length and throughout its circumferential extent to the outer surface of the foam dielectric 12 by a thin adhesive layer 16. Preferably, the adhesive layer 16 is an EAA or EMA copolymer as described above. The adhesive layer 16 should be made as thin as possible so as to avoid adversely affecting the electrical characteristics of the cable. Desirably, the layer of adhesive 16 should have a thickness of about 1 mil or less. The presently preferred method of obtaining such a thin deposit of adhesive and a suitable adhesive composition therefor are described in U.S. Pat. No. 4,484,023 to Gindrup.

The outer surface of the sheath 14, is optionally surrounded by a protective jacket 18. Suitable compositions for the outer protective jacket 18 include thermoplastic coating materials such as polyethylene, polyvinyl chloride, polyurethane and rubbers. The protective jacket 18 may be bonded to the outer surface of the sheath 14 by an adhesive layer 19 to thereby increase the bending properties of the coaxial cable. Preferably, the adhesive layer 19 is a thin layer of adhesive, such as an EAA or EMA copolymer as described above.

Figure 2:
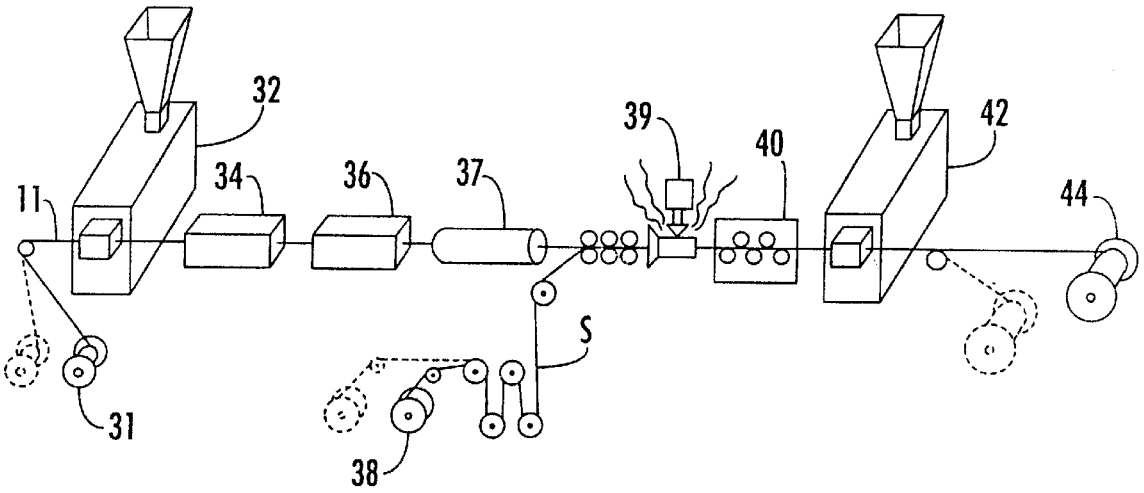
FIG. 2 is a schematic illustration of an apparatus for producing the improved coaxial cable of the invention.

FIG. 2 illustrates a suitable arrangement of apparatus for producing the cable shown in FIG. 1. As illustrated, the inner conductor 11 is directed from a suitable supply source, such as a reel 31, and an adhesive layer 13 is applied to the surface of the inner conductor. The coated inner conductor 11 is then directed through an extruder apparatus 32. The extruder apparatus 32 continuously extrudes the foamable polymer composition concentrically around the inner conductor 11. Upon leaving the extruder, the plastic material foams and expands to form a continuous cylindrical wall of the foam dielectric 12 surrounding the inner conductor 11.

Figure 1A:
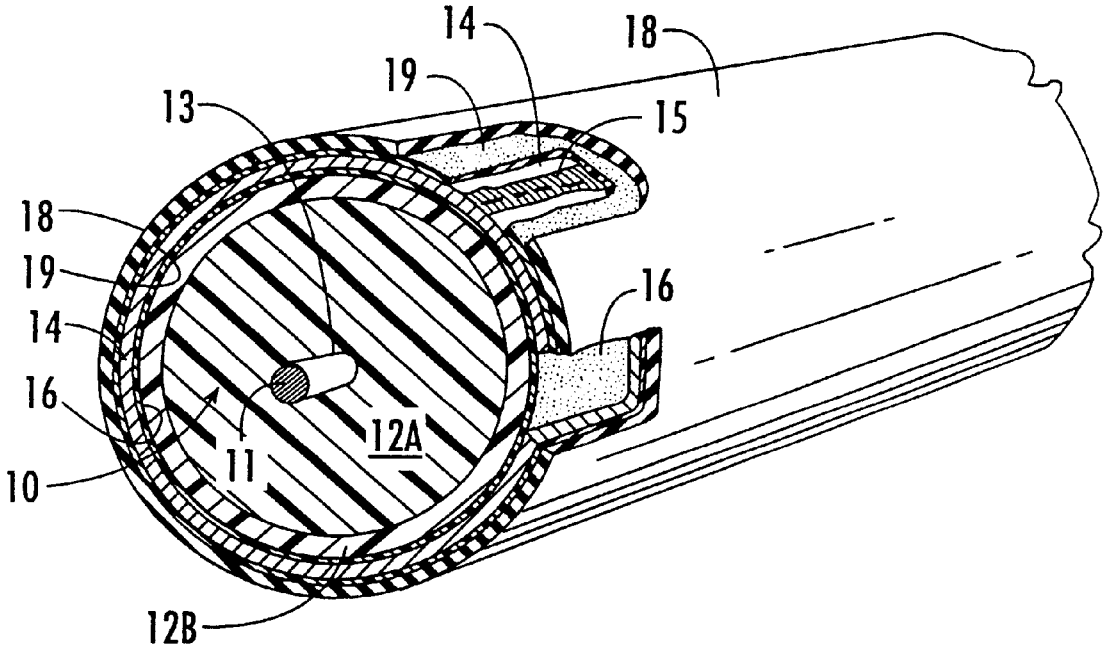

In an alternative embodiment of the invention, the foam dielectric 12 may have a gradient density wherein the density of the foam dielectric increases radially from an inner surface of the foam dielectric to an outer surface of the foam dielectric. The gradient density may be the result of altering the foamable polymer composition or the conditions exiting the extruder apparatus 32. Typically, however, the gradient density is provided by extruding a first foamable polymer composition and a second polymer composition in succession to form the foam dielectric 12. As shown in FIG. 1A the first and second polymer compositions may be coextruded or extruded separately to form an inner foam dielectric layer 12A and an outer dielectric layer. 12B once foamed and expanded, the outer dielectric possesses a greater density than the inner foam dielectric layer. The outer dielectric layer 12B may be a foamed dielectric or an unfoamed dielectric skin and may be formed from the same material as the inner foamed dielectric layer.12A The increased density at the outer surface of the foam dielectric 12 results in an increase in the core stiffness thus increasing the bending properties of the coaxial cable.

The outer surface of the core 10 is coated with a layer of adhesive 16 A copolymer adhesive composition is applied to the surface of the foam dielectric 12 by suitable applying means to form the adhesive layer 16. For example, the adhesive composition may be coextruded onto the foamable polymer composition or the second polymer composition in the extruder apparatus 32 or extruded onto the foam dielectric 12 in a separate extruder apparatus. Alternatively, the inner conductor 11 and surrounding dielectric 12 may be directed through an adhesive applying station 34 where a thin layer of an adhesive composition such as EAA or EMA is applied by suitable means, such as spraying or immersion. After leaving the adhesive applying station 34, excess adhesive may be removed by suitable means and the adhesive coated core 10 is directed through an adhesive drying station 36, such as a heated tunnel or chamber. Upon leaving the drying station 36, the core is directed through a cooling station 37, such as a water trough.

Once the adhesive layer 16 has been applied to the core 10, a narrow strip of metal S is directed from a suitable supply source such as reel 38 and is formed into a tubular configuration surrounding the core. The strip S then advances through a welding apparatus 39, and the opposing side edges of the strip S are positioned into butting relation and joined together by a continuous longitudinal weld. The core and surrounding sheath are then passed through a rolling or stationary reduction die 40 where the tubular sheath 14 is reduced in diameter and brought into close relationship with the core 10. The thus produced assembly may then pass through a coating extruder apparatus 42 where a polymer composition is extruded around the metal sheath 14 to form a protective jacket 18 surrounding the sheath. Additionally, prior to application of the polymer composition forming the jacket 18, a thin layer of adhesive 19 may be applied to the surface of the sheath 14 by suitable means such as coextrusion in the coating extruder apparatus 42. The coating extruder apparatus 42 also serves to activate the adhesive 16 and to thereby form a bond between the sheath 14 and the outer surface of the dielectric 12. The thus produced cable may then be collected on suitable containers, such as reels 44, suitable for storage and shipment. Typically, the diameter of the cable is greater than about 0.25 inch.

The coaxial cables of the present invention have enhanced bending characteristics over conventional coaxial cables. One feature which enhances the bending characteristics of the coaxial cable of the invention is that the sheath 14 is adhesively bonded to the foam dielectric 12. In this relationship, the foam dielectric 12 supports the sheath in bending to prevent damage to the coaxial cable. In addition, the foam dielectric 12 as described above may possess a gradient density to support the sheath in bending. Therefore, increased core stiffness in relation to sheath stiffness is beneficial to the bending characteristics of the coaxial cable. Specifically, the welded sheath coaxial cables of the invention have a core to sheath stiffness ratio of at least 5, and preferably of at least 10. In addition, the minimum bend radius in the welded sheath coaxial cables of the invention is significantly less than 10 cable diameters, more on the order of about 7 cable diameters or lower. The reduction of the tubular sheath wall thickness is such that the ratio of the wall thickness to its outer diameter (T/D ratio) is no greater than about 2.5 percent for cables having welded sheaths. The reduced wall thickness of the sheath contributes to the bending properties of the coaxial cable and advantageously reduces the attenuation in the coaxial cable. The combination of these features and the properties of the sheath 14 described above results in an outer sheath with significant bending characteristics.

As stated above, although coaxial cables having welded sheaths generally possess better mechanical properties than seamless sheaths, the present invention is also directed to seamless sheaths and improving the electrical and mechanical properties thereof. In these sheaths, the core to sheath stiffness ratio is at least about 2, and preferably at least about 5. In addition, the minimum bend radius in the seamless sheath coaxial cables of the invention is significantly less than 15 cable diameters, more on the order of about 10 cable diameters or lower. The reduction of the tubular sheath wall thickness is such that the ratio of the wall thickness to its outer diameter (T/D ratio) is no greater than about 5.0 percent for cables having seamless sheath constructions.

Furthermore, in addition to enhanced bending characteristics, the coaxial cable of the present invention possesses a velocity of propagation ($V_p$) greater than about 90 percent of the speed of light, and even greater than about 91 percent of the speed of light. The high values of $V_p$ can be attributed in great part to the expanded closed cell foam dielectric of the present invention.

Typically, the closed cell foam dielectric originates from pellets of a polymer, such as a polyolefin, added to the extruder apparatus 32. Exemplary polyolefins include polyethylene, polypropylene, and combinations or copolymers thereof Preferably, polyethylene pellets are used to form the foam dielectric 12 of the invention, and most desirably, the polyethylene comprises high density polyethylene (HDPE) or a combination of HDPE and low density polyethylene (LDPE).

It is conventional to incorporate with the polymer pellets, small amounts of a nucleating agent which will serve to provide nucleation sites for the gas bubbles during the foaming process. For example, U.S. Pat. No. 4,104,481 to Wilkenloh et al. describes the use of azobisformamides, such as azodicarbonamides, as nucleating agents in producing a foam dielectric for a coaxial cable. Since the nucleating agent is used in very small concentrations, e.g. as low as 0.01 percent by weight, masterbatch pellets containing a blend of the polymer and a relatively high concentration of the nucleating agent may be blended with unmodified polymer pellets to obtain the desired overall concentration of nucleating agent uniformly dispersed with the polymer. The nucleating agent-containing masterbatch pellets have traditionally been produced by compounding the nucleating agent with the polymer and forming pellets therefrom.

Nucleating agents may be characterized either as exothermic nucleating agents or endothermic nucleating agents. Exemplary exothermic nucleating agents include azobisformamides such as azodicarbonamides, commercially available from Uniroyal Chemical Co. under the Celogen trademark. Exemplary endothermic nucleating agents include sodium bicarbonate/citric acid agents, sodium carbonate/citric acid agents, sodium bicarbonate or sodium carbonate in combination wish other weak organic acids, and the like. The preferred nucleating agent for the present invention is a combination of exothermic and endothermic nucleating agents. Specifically, it has been discovered that a polyolefin polymer such as polyethylene, when expanded with a combination of an at exothermic nucleating agent and an endothermic nucleating agent, provides a closed cell foam dielectric with lower density than conventional foam dielectrics using polyethylene blended only with exothermic nucleating agents. Preferably, the nucleating agent is a blend of an azobisformamide exothermic agent such as an azodicarbonamide and a sodium carbonate/citric acid endothermic nucleating agent.

As stated above, nucleating agents typically have been compounded with the polymer to form pellets containing the nucleating agents. This involves thoroughly mixing the nucleating agents with the polymer in an extruder while heating to melt the polymer. The mixture is then extruded and chopped into pellets for use. In the present invention, it is especially preferred to use pellets having nucleating agents which have been subjected to little or no heating, i.e., pellets which have no thermal history. One method of providing nucleating agents without thermal history is to use a binder such as a thermoplastic resin. Typically, virgin pellets, beads, micropellets, powders, or granules of resin material are coated with a thermoplastic resin binder and then coated with the nucleating agent for use in the invention. Exemplary thermoplastic binders include polyethylene, ethylene vinyl acetate (EVA) copolymers, polystyrene, polyvinyl chloride, polyethylene terephthalate, nylon, fluoropolymers, and the like. The process of coating the resin with the thermoplastic binder and the nucleating agent occurs at temperatures below 200° F. so the properties of the nucleating agent are not affected. In the present invention, polyolefin pellets may be coated with a thermoplastic binder and an endothermiclexothermic nucleating agent blend. Pellets of this type are available, for example, from NiTech Inc. of Hickory, N.C.

The nucleating agent-coated pellets used in the invention generally include between about 80 to less than 100 percent by weight of the polyolefin, greater than 0 to about 20 percent by weight of the exothermic nucleating agent, and greater than 0 to about 20 percent by weight of the endothermic nucleating agent. Preferably, the pellets include between about 85 and 95 percent by weight of the polyolefin, between about 1 and 10 percent by weight of the exothermic nucleating agent, and between about 1 and 10 percent by weight of the endothermic nucleating agent. An exemplary useful pellet formulation for the foam dielectric of the invention includes 90 percent by weight HDPE, 7.5 percent by weight of the azobisformamide exothermic nucleating agent, and 2.5 percent by weight of the sodium bicarbonate/citric acid endothermic nucleating agent.

The nucleating agent-coated pellets are mixed with unmodified polyolefin pellets to provide the desired concentration of nucleating agent uniformly in the polymer raw material which is fed to the extruder apparatus 32. Preferably, between about 0.1 and 10 percent by weight of the pellets are HDPE pellets containing exothermic and endothermic nucleating agents and between about 99.9 and 90 percent by weight of the pellets are unmodified LDPE and HDPE pellets.

In the extruder apparatus 32 the polymer pellets are heated to a molten state, where they are further combined with a blowing agent such as nitrogen or carbon dioxide. This composition is extruded from the crosshead die of the extruder surrounding the center conductor 11, whereupon it expands and foams to produce the closed cell foam dielectric 12.

From the foregoing, it will be appreciated that a closed cell foam dielectric in accordance with the present invention is distinctly different from dielectrics produced with the use of conventional nucleating agents. For example, in addition to a lower density, the foam will be characterized by having residual amounts of both exothermic and endothermic nucleating agents. In addition, residual amounts of the thermoplastic resin binder (or degradation products therein) may be detectable.

The foam dielectric of the invention has a lower density, and provides greater core stiffness for a given density than foam dielectrics produced with previously known technology using azodicarbonamide nucleating agents. The density of the foam dielectric is less than about 0.22 g/cc, preferably less than about 0.19 g/cc, and more preferably less than about 0.17 g/cc. As is well known in the art, lower density in the foam dielectric 12 generally results in an increase in the velocity of propagation of the coaxial cable. In addition, a decrease in the density of the closed cells generally results in an increase in the cell size. The maximum size of the cells in the foam dielectric is typically less than about 170 microns and the mean cell size is between about 90 and 130 microns. Specifically, the maximum cell size at a density of 0.22 g/cc is about 125 microns, at a density of 0.19 g/cc is about 150 microns, and at a density of 0.17 g/cc is about 170 microns. Although not wishing to be bound by theory, it appears that the cell size and density in the present invention is attributable to the lack of heat history in the polymer pellets thus providing a nucleating agent with a higher fraction of fine particles and therefore a smaller mean particle size.

It is understood that upon reading the above description of the present invention, one skilled in the art could make changes and variations therefrom. These changes and variations are included in the spirit and scope of the following appended claims.

That which is claimed:

1. A method of making a coaxial cable comprising the steps of:

advancing a conductor into and through an extruder and extruding thereon a foamable polymer composition comprising a polyolefin, an endothermic nucleating agent and a blowing agent;

causing the foamable polymer composition to foam and expand to form a cable core comprised of an expanded foam dielectric surrounding the advancing conductor; and forming an electrically and mechanically continuous metallic sheath around the cable core to produce the coaxial cable.

2. The method according to claim 1 further comprising advancing the formed coaxial cable through a second extruder and extruding a second polymer composition around the metallic sheath to form a protective jacket surrounding the coaxial cable.

3. The method according to claim 1 wherein the foamable polymer composition further comprises an exothermic nucleating agent.

4. The method according to claim 1 further comprising extruding a second polymer composition onto the foamable polymer composition, wherein after the step of causing the foamable polymer composition to foam and expand, the second polymer composition has a greater density than the expanded foamable polymer composition.

5. The method according to claim 1 wherein the step of extruding the foamable polymer composition comprises coextruding the foamable polymer composition and a second polymer composition surrounding the foamable polymer composition, wherein after the step of causing the foamable polymer composition to foam and expand, the second polymer composition has a greater density than the expanded foamable polymer composition.

6. The method according to claim 1 wherein the foamable polymer composition further comprises a thermoplastic binder.

* * * * *